United States Patent [19]

Bergland

[11] 4,354,671

[45] Oct. 19, 1982

[54] SHEET HANDLING DEVICE

[75] Inventor: Paul W. Bergland, Sparta, N.J.

[73] Assignee: Bobst Champlain, Inc., Roseland, N.J.

[21] Appl. No.: 249,678

[22] Filed: Mar. 31, 1981

Related U.S. Application Data

[63] Continuation-in-part of Ser. No. 127,142, Mar. 4, 1980.

[51] Int. Cl.[3] ..... B65H 39/06

[52] U.S. Cl. ..... 270/58

[58] Field of Search ..... 270/58, 60, 45, 51, 270/54; 198/420, 422, 425, 461

[56] References Cited

U.S. PATENT DOCUMENTS

| | | | |
|---|---|---|---|
| Re. 12,051 | 11/1902 | Firm | 270/46 |
| 226,916 | 4/1880 | Hoe et al. | 270/58 |
| 277,548 | 5/1883 | Crowell | 270/46 |
| 318,143 | 5/1885 | Scott | 270/45 |
| 3,271,023 | 9/1966 | Disbrow et al. | 270/58 |
| 3,363,739 | 1/1968 | Mebus | 198/461 X |
| 3,520,395 | 7/1970 | Jablonski et al. | 198/422 |
| 3,614,087 | 10/1971 | Zernov et al. | 270/60 |
| 3,977,665 | 8/1976 | Bowman et al. | 270/54 |
| 4,149,711 | 4/1979 | Jackson | 270/57 |

*Primary Examiner*—Richard J. Apley
*Assistant Examiner*—A. Heinz
*Attorney, Agent, or Firm*—Hill, Van Santen, Steadman, Chiara & Simpson

[57] ABSTRACT

A sheet handling device for receiving either a flow of sheets or a flow of transverse rows of interconnected carton blanks from a discharge end of a processing apparatus and delivering the sheets or rows into the input end of a second processing apparatus characterized by a first conveyor path of belts extending between the input and exit ends of the device, a second conveyor path or belt having a longer or greater length than the first path extending from the input end to the exit end, nip rollers for forcing the belts of each path into engagement with each of the sheets in the first and second path to impart a new speed thereto, the ends of the first and second paths being arranged so that the sheets in the second path will be deposited on a following sheet traveling in the first path and a pivotable blade arranged adjacent the input ends of each of the paths for alternately directing the sheets into the paths. In order to be able to handle the transverse rows of inteconnected cartons which have substantially no spacing between adjacent rows as they are discharged from the processing apparatus, the input end includes rollers which can be driven at an accelerated speed to accelerate the passage of the rows to obtain a spacing between the rows to enable the pivotable blade to be actuated and each of the paths is provided with a control device for immediately decelerating the row after it is directed into one of the paths and prior to being received by the nip rollers.

7 Claims, 7 Drawing Figures

SHEET HANDLING DEVICE

CROSS REFERENCE TO RELATED APPLICATION

This is a continuation-in-part of my copending United States Patent Application, Ser. No. 127,142, filed Mar. 4, 1980.

BACKGROUND OF THE INVENTION

A sheet handling device for receiving a flow of successive sheets of individual blanks from a sheet processing apparatus, collecting the sheets into pairs of superimposed sheets and discharging each pair into a further processing machine at a reduced speed. In addition, the device can handle the individual rows of blanks, which are produced in the sheet processing apparatus, by collecting the individual rows of blanks and superimposing them with other rows of blanks to form pairs of rows which are discharged at a reduced speed.

A sheet handling device, which was adapted to be located between a carton blank processing apparatus which produces a sheet of interconnected carbon blanks and a delivery unit which will separate the sheet of interconnected blanks into individual blanks was disclosed in my copending U.S. patent application, Ser. No. 127,142, filed Mar. 4, 1980, which is incorporated herein by reference thereto. In this device, the carton blank processing machine such as a platen press will preform the steps of cutting and creasing blanks in a sheet of blanks, stripping the waste materials from the sheet and then deliver the sheet of stripped interconnected blanks for further processing. In such a device, the speed of the platen press is faster than the device which receives the stripped sheet of interconnected blanks and proceeds to separate the sheets into individual blanks or to further process the blanks. The sheet handling device of the above mentioned application acts as a collecting device which will reduce the speed of the sheets and will deposit a sheet of blanks in a flow of sheets on the next following sheet prior to exiting or being discharged from the device. For this device to operate, each of the sheets must have the individual die cut blanks held together by nicks to ensure that the entire sheet of blanks remains together during transport through the device.

In certain instances, particularly when the final carton being formed from the die cut blank cannot tolerate rough edges formed by nicks, the die cut sheet will have nicks which are so weak that they cannot hold the blanks together under the stresses that occur in the direction of transport or the sheet will be completely separated without any nicks to hold the blanks together in the direction of transport. Thus, the blanks exiting the processing device will be either weakly held together blanks which will pull apart along the transport direction or individual rows of cartons which are separated from the next adjacent rows of cartons of the same sheet. The above mentioned sheet handling device cannot be used in a collecting mode to collect the individual carton blanks or rows of carton blanks which are separate from the following carton blanks or row of blanks of the sheet when taken in the direction of transport. It should be noted that the sheet handling device does not create any substantial forces or stresses in the interconnected blank in a direction transverse to the transport direction. Thus the weak nicks between adjacent cartons in a direction transverse to the transport direction are still sufficiently strong enough to hold the carton blank together as they are carried by the sheet handling device.

SUMMARY OF THE INVENTION

The present invention is directed to providing an improved sheet handling device which can in addition to slowing down the speed of transport of sheets of blanks and depositing them in collected pairs can also be used to collect individual rows of interconnected cartons when taken in the direction of transport that were completely severed from the die cut sheet or will become separated while being transported from the proccesing apparatus.

To accomplish these tasks, the present invention is directed to an improvement in a sheet handling device for receiving a flow of sheets from a discharged end of a processing apparatus and discharging the sheets to an input station of a second apparatus, said device having a frame with an input end and an exit end; first means for forming a first path between said input and exit ends; second means for forming a second path between the input and exit ends, said second path being longer than said first path by an amount approximately equal to one-half of the spacing between the leading edges between two successive sheets in said flow of sheets in said processing apparatus, each of said means including coacting belts; means for selectively directing a sheet into said first and second paths, each of said first and second means having means for imparting a new speed of travel to the sheet traveling therein including a pair of nip rollers to press the coacting belts onto the leading edge of the sheet in each path; and the exit end of each of said first and second paths being arranged so that the sheet in said second path is deposited on the following sheet traveling in the first path after both sheets have reached the new speed of travel. The improvements comprise means arranged at the input end of the frame for accelerating the speed of advance of each individual row of cartons separated from a sheet as it is discharged from the processing machine, and control means disposed on each path immediately adjacent the means for directing for the deceleration of the row of cartons as it is directed into the selected path and prior to engagement by the pair of nip rollers of the means for imparting.

The means for accelerating preferably includes a pair of speed up rollers positioned to engage the leading edge of a row of cartons as the trailing edge is released by the discharged rollers of the processing device to accelerate the carton to enable a required separation between the next following row of cartons to allow the means for directing which includes an alternating plate to effectively direct the respective carton to the proper belt path. The speed up rollers will cause a gap to be formed between the engaged row and the following row of cartons which is sufficient to allow the alternating or deflector plate to change positions and to intersect this following row of connected cartons and direct it into the proper belt path. A speed up of approximately 30% over the speed of a row of cartons at the exit roll of the processing device usually will achieve the desired amount of separation although high speed may be used.

The speed up rollers need to be positioned one carton length relative to the discharged rollers of the processing device so that they engage the leading edge of the carton as the trailing edge is being discharged. Since the handling device will operate with different length cartons in the direction of travel, the entire device is mounted on wheels to enable movement of the handling device relative to the processing machine if the length of the cartons is changed. In addition, when handling sheets of interconnected blanks, the speed up rollers will be placed in close proximity to the discharged rollers of the processing apparatus and will be operated at the same speed as the discharge rollers so that the drive means for the speed up rollers include means to change or shift the speeds between an accelerated speed and a normal intake speed.

The coacting belts for each of the first means for forming a first path and the second means for forming a second path are each formed by a group of spaced apart upper belts and a group of spaced apart lower belts. One group of the two groups of coacting belts such as the group of upper belts of the first path and the group of lower belts of the second path will extend to a position immediately adjacent the flipper or deflecting blade of the means for directing. In fact, the deflecting blade is disposed between these two groups in the constructed device. However, the group of lower belts of the first path and the group of the upper belts of the second path are each spaced along the belt path from the blade by a given distance. Thus, the control means is interposed immediately adjacent the rear of the flipper blade of the means for directing to control the movement of each row of cartons on one group of belts of each path prior to the carton being engaged between the coacting groups of belts. The control means includes a pair of nip rollers with the first roller of each pair being a driven roller and engaging a carton as it moves along the one group of belts and the second nip roller being positioned behind the one group of belts and being a pressure roller acting on the belts. The second or pressure roller is adjustable to enable changing the amount of pressure applied on the group of belts to urge it against the first nip roller of each pair. The first nip roller of each pair is placed at the minimum distance which is approximately one carton length from the nip of the speed up rollers so that as the carton is released by the nips of the speed up rollers it is received or engaged between the belts and the first roller of each pair of the particular path. By adjusting the amount of pressure of the pressure roller, the amount of friction between the belts and the first roller can be adjusted to accommodate longer cartons than the minimum length. During use of the handling device on sheets of interconnected blanks, the pair of nip rollers can be completely removed from each path or the adjustable pressure roller is moved to a position to exert minimum pressure on the path so that a sheet entering into the path is not effected by the control means and is not slowed down until the leading edge is engaged in the pair of nip rollers of the means for imparting a speed of travel to the sheets.

DESCRIPTION OF THE PREFERRED EMBODIMENTS

Figure 1:
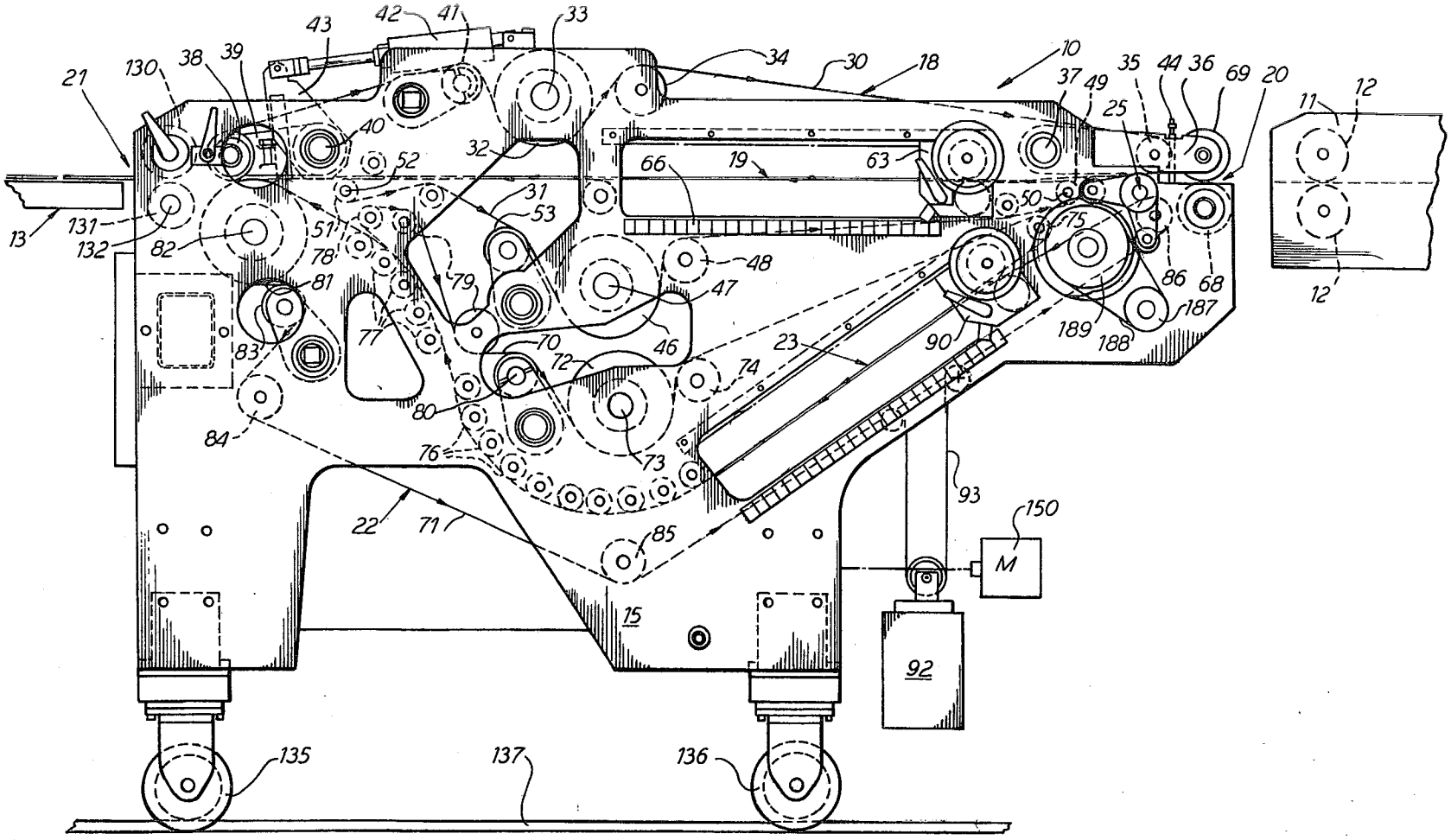
FIG. 1 is a side view of a sheet handling device in accordance with the present invention.

The principles of the present invention are particularly useful in a sheet handling device generally indicated at 10 which is arranged to receive a flow of sheets or a flow of cartons which flow of cartons may be either a plurality of individual cartons or rows of interconnected cartons which extend transverse to the direction of transport, from a processing apparatus generally indicated at 11, which for example is a die cutting and creasing press having a stripper and a discharge station defined by a pair of nip rollers 12. The device 10 is arranged to discharge the flow of sheets or carton at a receiving station 13 of a subsequent processing machine such as a delivery device or apparatus. Thus, the device 10 is part of an equipment line having various stations.

The device 10 includes a frame formed by a side frame elements 15 and 16 (see FIG. 6) which support first means, which is generally indicated at 18, for creating a first path, which is generally indicated at 19, between an input end, which is generally indicated at 20 and is adjacent the discharge nip rollers 12 of the apparatus 11 and an exit or output end 21 which is adjacent the subsequent receiving station 13. In addition, the frame support second means, which is generally indicated at 22, for creating a second path indicated at 23 that extends between the input end 20 and the output end 21. The frame also supports adjacent the input end a device 25 or means (best illustrated in FIG. 2) for alternately directing a blank or carton into either the first path 19 or the second path 23.

The first means 18 utilizes a plurality of upper conveying ribbons or belts 30 coacting with a plurality of lower continuous ribbons or belts 31. These ribbons or belts are spaced apart such as along the axis of a drive pulley or roll 32 for the upper belt and the axis of a drive pulley or roll 46 for the lower belts. Each of the upper spaced apart belts 30 is driven by the drive pulley 32, which is mounted on a drive shaft 33. Each of the belts 30 extends forward from the drive pulley 32 over an idler pulley 34 to a front end pulley or sheave 35 which is mounted on a shaft supported in a pair of pivot arms 36 that pivot about an axis of a shaft 37. From the front pulley 35, each belt extends under an adjustable idler 27 (FIG. 2) and then along the upper path 19 to a rear pulley 38 which is mounted on a shaft supported in pivot arms 39 that pivot about axis 40. From the rear pulley 38, the belt passes over a belt tightner 41 and reengages the drive pulley 32.

As described in the copending application, the rear or back pulleys 38 can be biased around pivot pint 40 against a stop by biasing means such as an air cyindrer 42 which acts on a lever arm 43, which is connected to the arms 39 to rotate them in a counterclockwise direction around a shaft 40. The arms 36 will rotate in a clockwise manner around the shaft 37 until limited by an adjustable stop 44.

Each of the lower belts 31 of the path 19 pass from the drive pulley 46 which is mounted on a drive shaft 47 over an idler pulley 48 to a front or leading edge pulley 49 mounted on a shaft 50 which is mounted by bearings in the side frames 15 and 16. After passing around the pulley 49, the belt extends along the first path 19 to a rear pulley such as 51 mounted on a shaft 52. From the pulley 51, the belt passes over a belt tightner or tensioning pulley 53 and returns to the drive pulley 46. As best illustrated in FIG. 2, the pulleys 49 on the shaft 50, which is fixed in the frame, and the front pulley 35, even while in its lowest position, are spaced apart so that the belts 30 and 31 may not be in tight engagement with each other.

To urge the belts 30 and 31 into tight engagement onto a sheet or blank, a pair of nip rollers 61 and 62 (FIG. 2), which are mounted in a housing 63 are provided. The position of the housing 63 can be adjusted by a rack and pinon arrangement in which a pair of racks 64 (FIG. 2) are mounted in the frames 15 and 16 along the first path 19 and are engaged by a pinion. The housing 63 will include an indicator, which indicates on a scale 66 the setting for the nip rollers 61 and 62. Briefly if the rolls are moved to the position illustrated in broken lines at 67 rolls are moved to any position along the scale 66 end of a sheet will not be engaged by the belts 30 and 31 until it extends between the nip rollers 61 and 62. Thus, the adjustment of the position of the housing 63 will adjust the position of nip rollers 61 and 62 along the path 19 and increase their distance from a pair of over speed or speed up rollers 68 and 69 which are adjacent the inlet 20 of the device 10. The purpose of the nip rollers 61 and 62 is to control when a sheet of interconnected blanks is tightly engaged by the belts 30 and 31 which preferably are moving at a reduced speed with respect to the speed of the sheet while it is engaged by the rollers 68 and 69. Thus, the nip rollers 61 and 62 are positioned to engage the leading edge of the sheet as the trailing edge passes through and is released by the rollers 68 and 69 to decelerate or change the speed of the sheets of interconnected blanks.

The second means 22 forming the second path 23 includes upper spaced belts 70 and lower spaced belts 71. In a manner similar to the belts of the first path 19, each of the spaced belts 70 passes over a drive pulley or roller 72 on a drive shaft 73 around an idler 74 to a lead pulley 75 (FIG. 2) on a shaft 60. From the lead pulley or front end pulley 75, each belt passes around a plurality of idler pulleys such as a first group 76 and a second group 77 to a rear pulley 78. From the rear pulley, it passes over a pair of spaced idlers 79 to a tension device 80 and back to the drive pulley 72. Each of the lower belt 71 has a drive pulley 81 mounted on a shaft 82. From the drive pulley 81, each belt passes over a tensioning device or pulley 83, an idler 84, a second idler 85 to a front pulley or sheave 86. From the front pulley 86, each belt extends along the second path 23 through a pair of nip rollers 88 and 89 (FIG. 2), which are mounted in the housing 90 (FIG. 2). From the nip rollers the belt engages the first group of idlers 76 and the second group of idlers 77 until it is received by the drive pulley 81.

Figure 2:
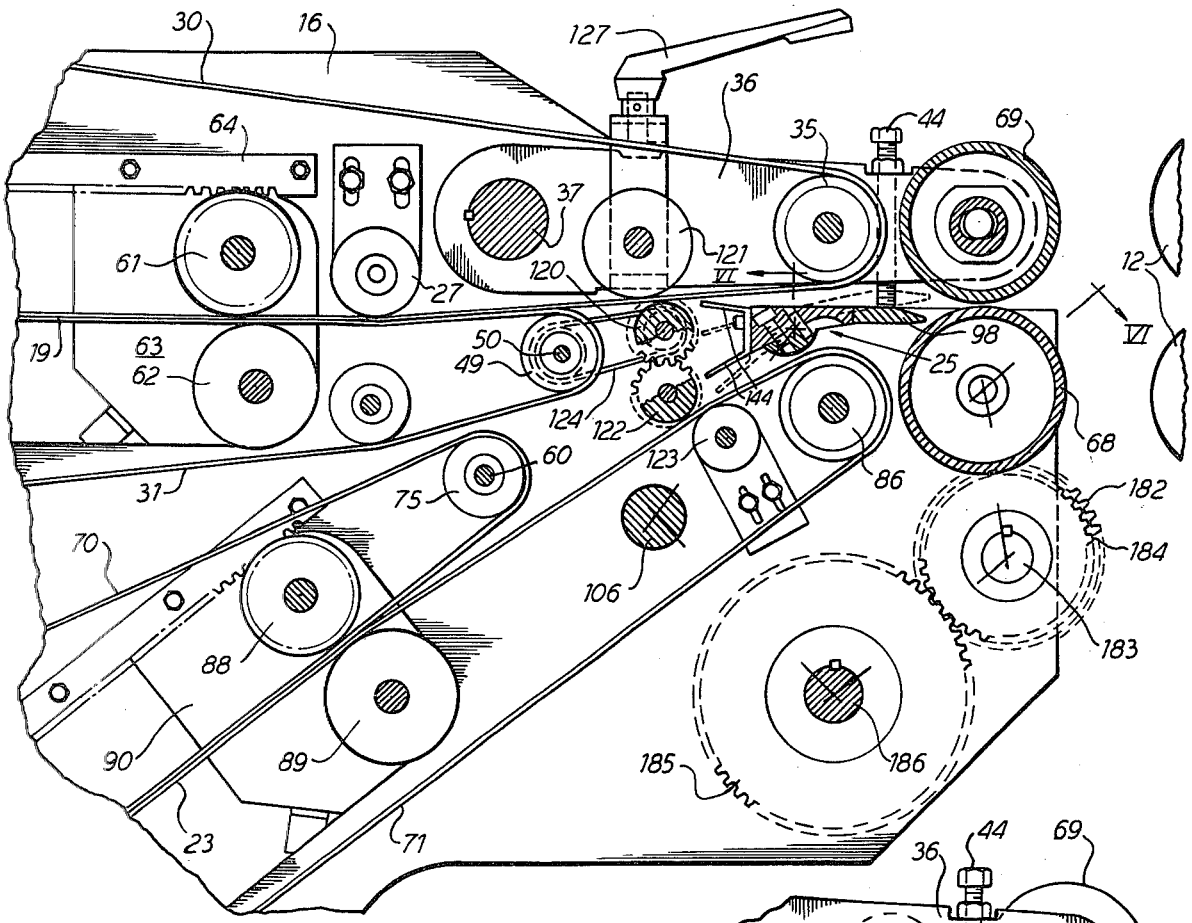
FIG. 2 is an enlarged cross-sectional view of the input end of the device with portions broken away and portions in elevation.

As illustrated in FIG. 2, the position of the pulleys 75 and the front sheave 86 are such that the belts 70 and 71 may be spaced apart until they are forced into engagement with a sheet of interconnected blanks by the pair of nip rollers 88 and 89. As in the case of the first path, a blank that is deflected into the second path 23 will travel at the speed of the over speed or speed up rollers 68 and 69 until the trailing edge is released therefrom and the leading edge is between the nip rollers such as 88 and 89. The position of the nip rollers and the housing 90, which position is adjusted by means of a rack and pinion arrangement, compensates for the length of the blanks being handled. It should be noted that due to the movement along a non-horizontal path, a counter weight 92 (FIG. 1) is connected by a chain 93 around a series of idler rolls to the housing 90 as best described in the copending application. Also, the position of the housing 90 can be locked in an adjusted position by clamps connected by the housing.

Figure 3:
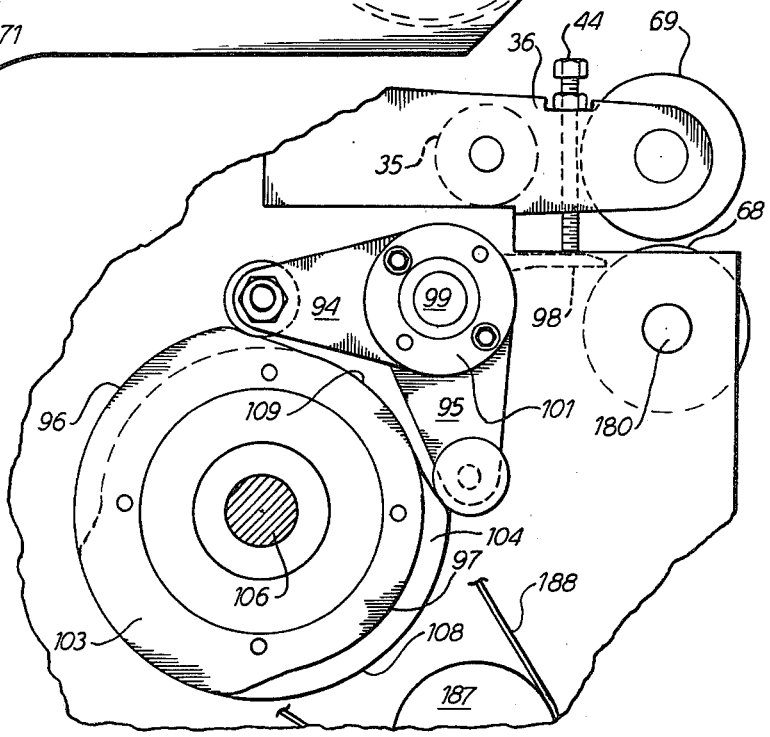
FIG. 3 is an enlarged view of the cam arrangement adjacent the input end of the device of FIG. 1 taken along lines III—III of FIG. 6.
Figure 6:
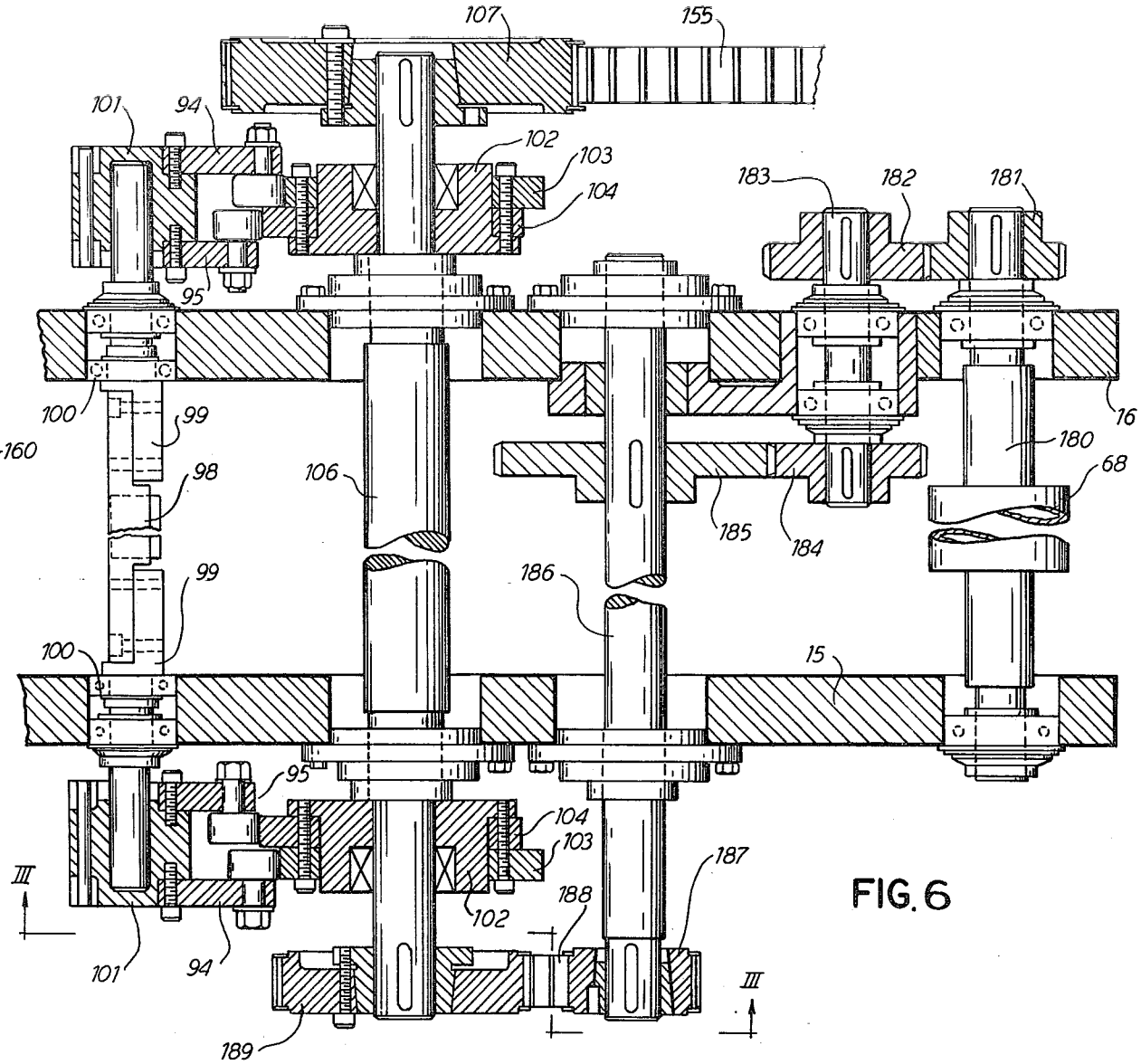
FIG. 6 is a cross-sectional view taken along lines VI—VI of FIG. 2.

To direct each of the blanks alternately into the first and second paths, the direction means 25 is provided. As best illustrated in FIGS. 3 and 6, the means includes a directing plate or blade 98 which is mounted on a pair of shafts 99, which are each supported by a bearing 100 for pivotable movement in the side frame members 15 and 16 and has a portion extending outside of the frame member. As illustrated, a cam lever arrangement 101, which has arms 94 and 95 with cam followers (FIG. 3), is mounted on each exposed end. A double cam support 102 with cam plates 103 and 104 is mounted on each end of a shaft 106 which is driven by a pulley 107. The follower of arm 94 rides on the surface of cam plate 103 and the follower of arm 95 rides on the surface of cam plate 104. Each cam plate 103 and 104 has two different diameter sectors such as 96 and 97 for the plates 102 and sectors 108 and 109 of the plate 103 and the sectors of each plate are joined together so that when the larger diameter sector 96 is engaged by the cam follower of arm 94 and the follower of the arm 95 is in the smaller diameter sector 109, the arrangement 101 is moved in a clockwise direction to have the blade 98 in a position to direct the sheets into the first path formed by the belts 30 and 31. When the smaller diameter portion 97 is engaged by the follower of cam 94 and the follower of the cam 95 engaged the larger sector 108, the arrangement 101 will be moved in a counterclockwise direction to shift or rotate the blade 98 to the position illustrated in broken lines (FIG. 2) to deflect a blank into the second path 23. As illustrated in FIG. 2, a pair of deflector plates 144 are attached to the blade 98 to provide extensions to aid in directing the sheet into one of the first or second paths.

Referring back to FIG. 1, the second path 23 is longer than the first path 19 preferably by a distance equal to one half the distance between leading edges of two successive sheets of interconnected blanks in the device 11. Thus, when using the device 10 to handle sheets of interconnected blanks as discussed in the copending application, a sheet which is traveling in the second path 23 is brought towards the merging area defined by the combination of the pulleys 81 and 38 and will be deposited under a following sheet which is traveling in the shorter first path 19. Thus, the two sheets can be married or superimposed in the desired registration. In addition, since each of the belts in both the first and second paths are moving at a slower speed, which is preferably one-half of the linear speed of the sheet while in the apparatus 11, the sheets will be decelerated to the desired slower speed and then deposited into a superimposed sheet arrangements for discharge through a final discharge nip formed by an idler roller 130 and a driven roller 131 which is mounted on the shaft 132.

When handling the die cut sheet as mentioned above, each of the blanks are interconnected to adjacent blanks in the sheet by nicks. However, in certain applications, the nicks are so fine that rows such as 110, 111, 112 (FIG. 7) which are following each other in the direction of travel 116 will become separated due to stresses being applied to the rows by the various nip rollers and belts. Thus, the row of cartons will become separated in the direction of travel however the device will not affect the interconnection between the cartons in each row or in a direction transverse to the direction of travel. It is also noted, that it is very desirable in certain applications to provide a clean cut surface on certain edges of the blanks for aesthetic purposes so that one row of carton blanks is completely separated in the processing apparatus 11 from the following row. These rows of blanks due to their short length cannot be processed in the device which is disclosed in the copending application.

The improvement of the present application is that the device 10 includes the means for speeding up the advance of each of the rows of blanks such as 110–115 to increase the separation between adjacent rows such as the separation between the row 110 and row 111 to enable actuation of the directing means 25. The means for accelerating is formed by the overspeed rollers 68 and 69. In order to control the movement of the directed rows of carton blanks, the device 10 also includes control means disposed along each of the paths 19 and 23 immediately adjacent the rear end of the deflector plate 98 for decelerating the carton or row of cartons as it is directed into the selected path and prior to engagement by the pair of nip rollers such as 88 and 89 for the path 23 or 61 or 62 for the path 19. As best illustrated in FIG. 2, the control means includes a pair of nip rollers 120 and 121 for the upper path 19 and a pair of nip rollers 122 and 123 for the lower path 23. The nip rollers 120 and 122 are driven rollers with the roller 120 being driven by a belt 124 that extends from the shaft 50 and rollers 120 and 122 being in driven connection by gears disposed on the ends of the shafts. The nip roller 121 and the nip roller 123 are each pressure rollers which act on each of the belts 30 and 71 to urge it into engagement with the nip roller 120 and 122, respectively. Each of the rollers 120 and 122 are mounted a given distance from the nip of the rollers 68 and 69 which distance is the minimum length of a carton which can be handled by the device 10. Each of the rollers 121 and 123 are mounted for vertical adjustment relative to the plane or direction of movement of the belt so that the amount of pressure and thus the amount of friction between the surface of the belt such as 30 and the surface of the roller 120 can be adjusted. As illustrated, the roller 121 is mounted by a fine threaded adjustment which is actuated by a handle 127. By adjusting the position of the rollers 121 and 123 relative to the belts to determine the amount of friction between the rollers 120 and 122 and their belts, cartons, which have a length in the direction of 116 that is slightly greater than the minimum length, can be controlled. Thus the maximum friction force is used for the smallest minimum carton length which is approximately eight inches along the direction of travel. If a row of cartons has a length in the direction of travel which is greater than eight inches, the adjustable roller such as 121 and 123 are adjusted to reduce the frictional force so that the deceleration occurring by engagement on the roller such as 120 and the belts 30 does not take effect while the trailing end of the carton is still engaged in the overspeed roller 68 and 69. It is also noted that the adjustable pressure roller 27 acts to hold the belts together until the belts are engaged in the adjustable nips such as 61 and 62 for the upper path 19.

It should be noted that when handling sheets of interconnected blanks the overspeed rollers 68 and 69 are adjusted to rotate at the same linear speed as the output rollers 12 of the device 11 and the various adjustable pressure rollers 27, 121 and 123 are retracted to their furthest position so that no frictional forces are applied between the driven nips 120 and 122 and the respective belts 30 and 171 and that the first engagement of the blanks will be accomplished by the adjustable nips such as 61 and 62 or 88 and 89. Also, the device 10 will be moved on wheels or casters 135 and 136 which have a V-groove so that they ride on a guide rail 137 to maintain alignment as the device is moved towards and away from the apparatus 11.

Figures 4, 7:
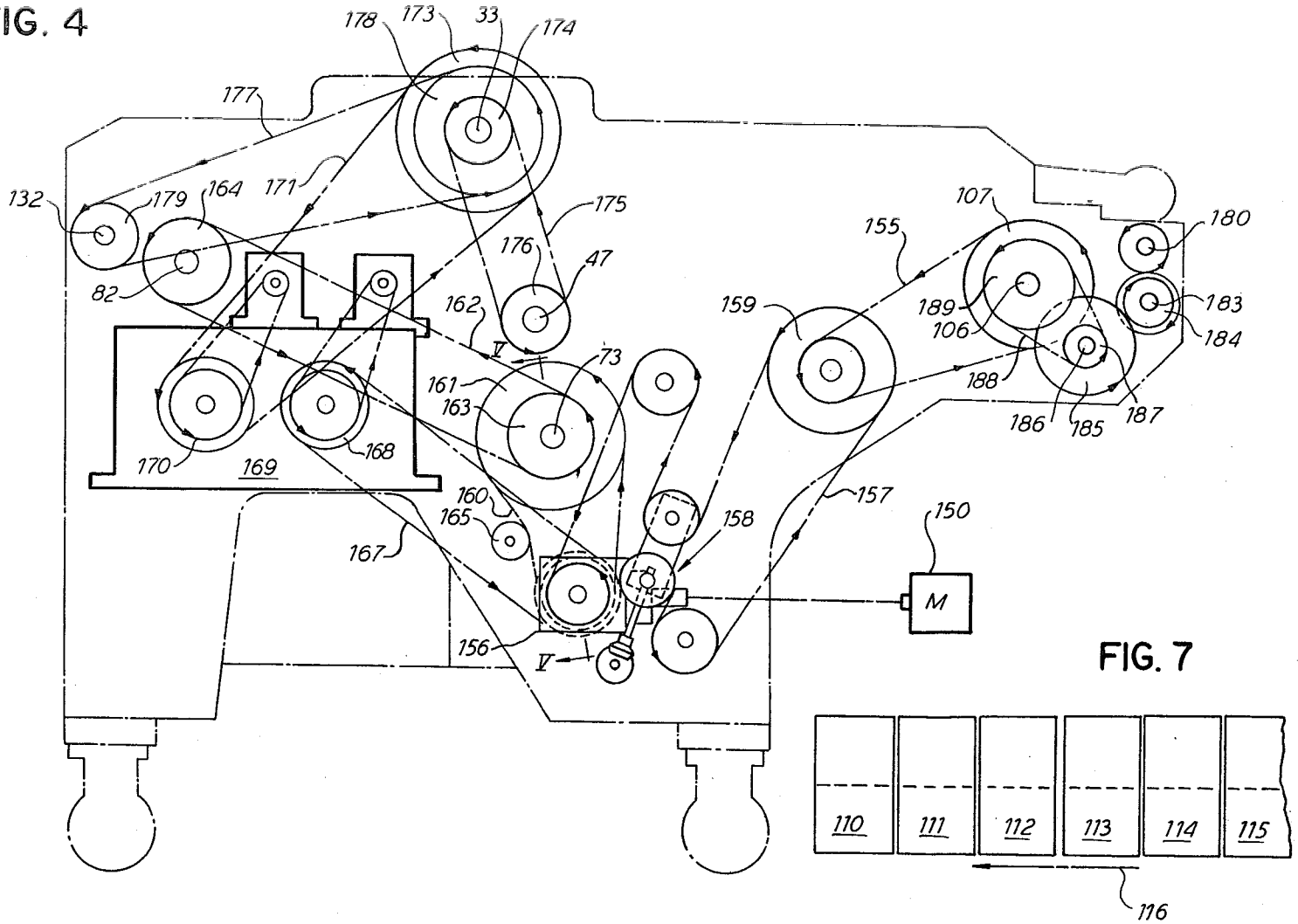
FIG. 4 is a cross-sectional view schematically illustrating the power train for the sheet handling device in accordance with the present invention.
FIG. 7 is a schematic view illustrating movement of a plurality of blanks which are interconnected row of cartons in a direction transverse to the direction of transport.
Figure 5:
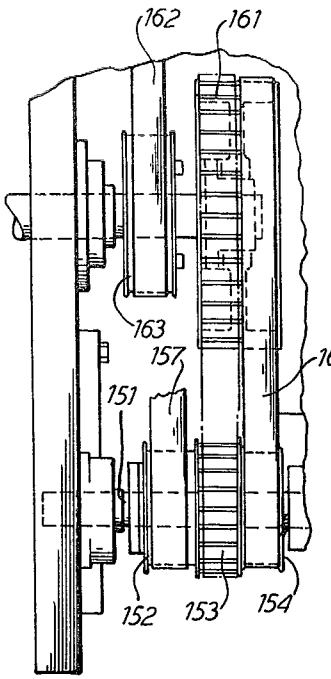
FIG. 5 is a partial cross-sectional view taken with portions in elevation taken along lines V—V of FIG. 4.

The device 10 is driven by a power source 150 which may be an electric motor or can also be a power source of the processing machine 11. As illustrated in FIG. 4, the device 10 has an angle box 156 that has an input connected to a source 150 by a connection which may include and a clutch arrangement. The angle box 156 has an output shaft 151 (FIG. 5) which supports a plurality and a drive pulley 152, 153 and 154. A drive belt 157 (FIG. 4) which extends from a pulley 152 of the shaft 151 and has a slide arrangement 158, drives a pulley arrangement 159, which in turn drives a belt 155 extending to pulley 107 connected to the shaft 106 to rotate the cam supports 102. Due to the presence of the slide arrangement 158, the angular relationship of the shaft 106 and the respective cam plates 103 and 104 can be adjusted relative to the output of the angle box 156 to enable adjusting the cam to actuate the plate 98 at the desired time.

From either the pulley 153 or 154 another belt 160 goes to a pulley 161 which is connected to a drive shaft 73 for the drive pulley 72 of the upper belt 70 of the second path 23. In addition, a belt 162 connects a pulley 163 attached to the shaft 73 to a pulley 164 which is attached on the drive shaft 82 for the drive pulley of the lower belt 71 of the second path. It should be noted that the pulley 161 if desired can be provided with a connection including a clutch which enables disconnecting the pulley in the event the lower path is to be disengaged from the drive source. Also the pulley 161 is wide enough so that it can receive the belt 160 when it extends from either pulley 153 or 154 and a belt tightner 165 acts on the belt 160 to take up any slack therein.

From the angle box 156, a belt 167 extends to an input pulley 168 of a transmission 169. An outlet pulley 170 of the transmission 169 drives a belt 171 which is connected to a pulley arrangement 173 which is coupled to the drive shaft 33 for the drive pulley 32 of upper belt 30 of the first path 19. A pulley 174 on the shaft 33 is connected by a belt 175 to a pulley 176 on shaft 47 for the drive pulley 46 of the lower belt of the path 19. In addition, a drive belt 177 extends from a pulley 178 on shaft 33 to drive pulley 179 that is connected to the shaft 132 of the driven nip roller 131. The transmission 169 can be a conventional transmission, which enables varying the speed of the first path 19 in relation to the speed of the second path 23 so that small adjustments can be made to obtain a desired registration or to obtain a desired overlap between the superimposed sheets. In addition, the transmission can be constructed to enable increasing the speed of the upper first path 19 to be the same as or less than, the speed of conveying in the apparatus 11 so that when the collecting and superimposing two sheets is not required, a direct passage along the first path 19 can be utilized.

To drive the overspeed roller 68, the roller 68 has a shaft 180 (see FIG. 6) that has a spur gear or pinion gear 181 mounted thereon. The gear 181 engages a pinion 182 on a shaft 183 which in turn has a pinion 184 that engages a drive gear 185 of a shaft 186. The shaft 186 has a drive pulley 187 connected by a drive belt 188 to a drive pulley 189 on the cam shaft 106. Thus, the overspeed roller 68 is driven by the cam shaft 106. The other overspeed roller 69 has a rubber surface and is free to rotate as a blank or sheet passes between the two rollers.

While the device 10 is handling sheets of interconnected blanks, the cam shaft 106 makes one revolution for each two sheets received from the apparatus 11. The number of teeth on the various gears such as 181, 182, 184, 185 and the drive pulleys 187 and 189 is selected so that the peripheral speed of the speed up roller 68 will be the same as the peripheral speed of the discharge rollers 12 of the apparatus 11. When the device 10 is being set up to operate and handle the individual cartons or transverse rows of connected cartons, the cam shaft 106 needs to rotate one revolution for each sheet being processed in the apparatus 11. Thus, the size of drive pulleys such as 107, as well as the particular configuration of the cams carried on the cam supports 102 needs to be changed. This changing of the speed of the drive for the shaft 106 will cause the roller 68 to be increased in its peripheral speed to a much higher percentage over the speed of the discharged rollers 12. To have the desired speed if necessary, the pulleys 187 and 189 as well as the belt 188 may also be changed so that the selected percentage of acceleration is obtained.

It is also noted that when handling sheets of interconnected blanks, the lower path as well as the upper path are both going at approximately one-half of the output speed of the apparatus 11. Such a speed is obtained when the belt 160 extends from the drive pulley 154 to the drive pulley 161 (FIG. 6). The upper belt mentioned hereinabove will have its speed selected by the adjustments in the transmission 169. When shifting to handle individual cartons or transverse rows of cartons, the speed of both the first and second paths of belts preferably is slightly higher than one-half of the discharge speed of the apparatus 11 to maintain the cartons in the desired spacing. In such an instance, the speed of the upper belt can be adjusted through the transmission 169 and the speed of the lower or second belt path 23 is adjusted by moving the drive belt 160 from the pulley 154 to the larger pulley 153 which has a greater number of teeth and therefore will drive the pulley 161 on the drive shaft 73 at a slightly higher speed. The belt tightner such as 165 will compensate for the change of the length of the belt when engaged on the pulley 153 instead of the pulley 154.

When handling the individual cartons or the row of cartons, the particular sequence and pattern of discharge from the outlet of the device 10 will depend on the number of rows associated with each sheet. For example, if the sheet consists of three rows such as 110, 111, and 112 with the next following sheets having the rows 113, 114 and 115, the spacing between the individual rows 110, 111, 112 of each of the sheets will be substantially zero as each row is being discharged from the apparatus 11. Due to the increased acceleration of the sheets as it is engaged in the speed up roller 68 and 69, a sufficient gap will be provided between each of the rows such as 110 and 111 to allow the blade 98 to move between its two positions to direct the rows as desired. When handling sheets having three rows in the direction of transport 116, the first row 110 will be passed into the first path 19, the second row 111 will be deflected into the second path 23 and the third row 112 will be passed into the first path 19. In the next sheet, the first row 113 will go into the first path, the middle row 114 will go into the second path and the third row 115 will go into the first path. Due to the fact that both the belts in both paths while handling the rows of cartons are running at a faster speed than one-half of the peripheral speed of the discharge from the apparatus 11, an due to the fact that three rows are provided in each sheet, the sheets in the second path will be deposited or superimposed on the sheets in the first path in the following manner. The carton or row 111 of cartons will be deposited on the first row or carton on the next following sheet which is the row 113. After the first two sheets of rows have passed through the device, the output will be a stack of two superimposed rows, a space, a single row, then another stack of two cartons.

If the sheets being processed have only two rows in the direction of transport 116, three sheets will be formed with the cartons 110 and 111 forming the first sheet, the cartons 112 and 113 forming the second sheet and the cartons 114 and 115 forming the third sheet. As in the previous embodiment, the last row such as 111 of the first sheet will be spaced a substantial distance from the first row 112 of the next following sheet but the spacing between the rows such as 112 and 113 of the sheet will be very small. Thus, the speed up rolls such as 68 and 69 will increase the speed of movement to increase the spacing between each of the rows 110–115. It will be noted that even with the speed up spacing, the spacing between the last row of one sheet and the first row of the next succeeding sheet will be substantially greater than the spacing or separation between two rows of the same sheet. The directing means 25 is operated so that the first row 110 will placed in the upper first path, and the second row such as 111 will be placed in the lower path. This is repeated so that the rows 110, 112, and 114 are all in the upper path while the rows 111, 113 and 115 are all in the lower path. Again, the sheets in the lower path will be deposited or placed under the sheets in the upper path with the row 111 being superimposed with the row 112 of the next following sheet, and the row 113 is superimposed with the first row 114 of the following sheet. Thus the discharge from the device 10 will be groups of two superimposed rows of cartons.

Although various minor modifications may be suggested by those versed in the art, it should be understood that I wish to embody within the scope of the patent granted hereon, all such modifications as reasonably and properly come within the scope of my contribution to the art.

I claim:

1. In a sheet handling device for receiving a flow of sheets at a given speed of travel from a discharge end of a processing apparatus and discharging the sheets in superimposed pairs of sheets to an input station of a second apparatus, said device having a frame with an input end and an exit end; first means for forming a first path between said input and exit ends; second means for forming a second path extending between the input and exit ends, said second path being longer than said first path by an amount equal to approximately one-half the spacing between the leading edges of two successive sheets in said flow of sheets in said processing apparatus and having a portion merging with the first path adjacent the exit end wherein a sheet in the second path is deposited on a following sheet traveling in the first path to form the superimposed pair of sheets for discharge from the exit end, each of said means including coacting belts; and means for selectively directing sheets into said first and second paths, each of said first and second means having means for imparting a new speed of travel to each sheet traveling therein, including a pair of nip rollers to press the belts onto the leading edge of each sheet in the first and second paths to attain a new speed of travel for each sheet prior to forming the superimposed pair of sheets; the improvement comprising means for handling transverse rows of cartons cut from a sheet being discharged from the processing apparatus, said means for handling including means arranged at the input end of the frame for accelerating the speed of advance of each transverse row of cartons cut from a sheet as it is discharged from said processing apparatus and control means disposed along each path immediately adjacent the means for directing for engaging and decelerating the row as it is directed into the selected path and prior to engagement by the pair of nip rollers of the means for imparting.

2. In a sheet handling device according to claim 1, wherein said means for accelerating includes a pair of rollers positioned to engage the leading edge of each row as the trailing edge is released by a pair of discharge rollers of the processing apparatus.

3. In a sheet handling device according to claim 1, wherein the coacting belts of each path have two groups of belts with one group having a path beginning immediately adjacent the means for directing and each of the control means includes a pair of nip rollers with a first roller of each pair being driven and engaging a row moving along the one group of belts and the second nip roller of the pair being a pressure roller acting on each belt of the one group to urge it towards the first roller.

4. In a sheet handling device according to claim 3, which includes means for adjusting the position of each of the second rollers of each pair so that the amount of friction between the first roller and the belts is varied to enable handling rows of cartons of different lengths in the direction of travel.

5. In a sheet handling device according to claim 3, wherein the means for accelerating includes a pair of rollers positioned to engage the leading edge of a row as the trailing edge is released by a pair of discharge rollers of the processing apparatus.

6. In a sheet handling device according to claim 1, wherein the means for imparting a new speed of travel imparts a speed which is less than the given speed of travel of the row being discharged from the processing apparatus so that a row upon being received by the device is first accelerated to an increased speed by the means for acceleration, directed into one of the first and second paths and subsequently decelerated to a speed lower than the given speed of discharge from the processing apparatus.

7. In a sheet handling device according to claim 6, wherein the coacting belts of each path have one belt with a path beginning immediately adjacent the means for directing and each of the control means includes a pair of nip rollers with a first roller of each pair being driven at the same speed as the one belt and engaging a row moving along the one belt and the second nip roller of each pair being a pressure roller urging the one belt towards said first roller so that the control means decelerate a row to the speed of the belt prior to engagement in the means for imparting.

* * * * *